US005415020A

United States Patent [19]

Allenbaugh

[11] Patent Number: 5,415,020

[45] Date of Patent: May 16, 1995

[54] LATCH GUARD FOR OUTWARDLY OPENING DOORS

[75] Inventor: Howard M. Allenbaugh, Huntington Beach, Calif.

[73] Assignee: M.A.G. Eng. & Mfg. Inc., Huntington Beach, Calif.

[21] Appl. No.: 54,876

[22] Filed: Apr. 28, 1993

[51] Int. Cl.[6] ..... E05B 15/02

[52] U.S. Cl. ..... 70/417; 49/462; 70/418; 292/346; D8/349

[58] Field of Search ..... 70/416–418, 70/136; 292/346, 340; 49/462, 460; 52/210; D8/349, 354, 366

[56] References Cited

U.S. PATENT DOCUMENTS

| | | | |
|---|---|---|---|
| D. 229,665 | 12/1973 | Wilmot | D8/137 |
| 2,489,072 | 11/1949 | Ausubel | 49/460 |
| 3,290,081 | 12/1966 | Sushan . | |
| 3,405,962 | 10/1968 | Sushan . | |
| 3,796,071 | 3/1974 | Crepinsek | 70/417 X |
| 4,130,311 | 12/1978 | Sushan | 292/346 |
| 4,484,463 | 11/1984 | Hennessy | 292/346 X |
| 4,547,009 | 10/1985 | Allen | 292/346 |
| 4,725,084 | 2/1988 | Catricola | 292/346 X |
| 4,751,834 | 6/1988 | Beck | 70/417 X |
| 4,861,082 | 8/1989 | Priola et al. | 292/346 |
| 4,885,921 | 12/1989 | Sharav | 70/416 X |
| 5,131,189 | 7/1992 | Mascotte | 70/418 X |
| 5,269,100 | 12/1993 | Fontenot | 49/460 |

FOREIGN PATENT DOCUMENTS

| | | | |
|---|---|---|---|
| 2911 | 7/1931 | Australia | 70/416 |
| 65913 | 3/1943 | Norway | 70/416 |

OTHER PUBLICATIONS

"Latch Protector," 3 photographs, date: unknown. Packaging and product by Don-Jo Mfg., Inc.

Latch Guard using Notched Bolt, 3 photographs, dated: unknown.

"Scotsman DorGard III," pp. 1–4, date: unknown. Sales Literature by Scotsman Security.

"Sentry's Lock Blocker LG-2," pp. 1–2, date: unknown. Packaging by Sentry Door Lock Guards, Inc.

Levine, "DorGard TM : designed to protect a door from attack," Locksmith Ledger, pp. 86–87, Oct. 1990, Total pages 2.

*Primary Examiner*—Lloyd A. Gall

*Attorney, Agent, or Firm*—Pretty, Schroeder, Brueggemann & Clark

[57] ABSTRACT

A door latch guard for guarding the latch of an outwardly opening door and for preventing spreading of the door away from an adjacent door frame comprises a cover plate having a first flat portion for connection to the door and a second flat portion adapted to overlie the adjacent door frame. A third portion of the cover plate, between the first and second flat portions, defines a groove adapted to overlie the door and the door frame and to receive a protruding latch strike plate. The groove includes a flat outer portion having a width adapted to accommodate locks installed in the door at a plurality of different backsets. In addition, the cover plate has a cut-out adapted to allow the cover plate to be mounted flat against the door, without interfering with the door lock hardware, yet still receive the protruding latch strike plate, regardless of the backset at which the door locks are installed.

16 Claims, 1 Drawing Sheet

LATCH GUARD FOR OUTWARDLY OPENING DOORS

BACKGROUND OF THE INVENTION

The present invention relates to door security hardware and, more particularly, to a door latch guard for guarding the latch of an outwardly opening door.

Conventional door locking mechanisms typically utilize a retractable spring-loaded latch operated by a door knob rotatable from either side of the door. When the door is closed, the latch contacts a latch strike plate causing the latch to recede within the door until it is aligned with a socket formed within the door jamb or frame. Once aligned, the latch springs into the socket to retain the door in the closed position. The door knob typically has a button-type locking mechanism on one side which can be actuated to prevent the knob from being rotated to retract and disengage the latch from the socket. The opposite side of the door knob typically has a key mechanism for disengaging the locking mechanism so that the knob can be rotated to retract the latch from the socket and open the door.

Knob-type door locks of the type described above often can be violated by techniques commonly used by unwanted intruders. For example, many latches can be disengaged from the socket by simply sliding a flexible strip of material, such as a plastic credit card, between the door and the door frame, thereby allowing the door to be opened even though the door knob is incapable of being rotated. Other tampering techniques include inserting rigid objects, such as jimmy bars or screwdrivers, between the door and the door frame to pry the latch from the socket. The door latch also can be disengaged from the socket by spreading the vertical frames of the door at the level near the latch. In order to spread the frame, intruders commonly use a car-jack type device positioned horizontally between the vertical frames of the door at the level of the latch. When the jack is cranked, it spreads the vertical frames such that the latch becomes partially or totally removed from the socket, allowing the door to be opened or easily kicked open by the intruder.

To avoid the problems associated with most knob-type locking mechanisms described above, the owners of commercial and residential buildings often install a dead bolt lock in the door, in addition to the knob-type lock. Unfortunately, although dead bolt locks are less susceptible to being violated by plastic credit cards and the like, they are not totally resistant to forced methods of entry involving spreading of the vertical frames around the latch to facilitate kick-in attacks.

To further combat the above-identified problems, so-called latch guards have been developed. A typical latch guard comprises an elongated cover plate connected to the door and having a portion adapted to overlie the adjacent door frame. To accommodate the latch strike plate extending outwardly from the door frame, the cover plate has an elongated V-shaped groove to provide a space on the inside surface of the cover plate for receiving the protruding latch strike plate. These latch guards also include an anti-spread pin in the portion of the cover plate that overlies the adjacent door frame. The anti-spread pin typically has a shaft adapted to extend into a hole in the door frame to limit spreading of the frames by an intruder using the methods described above.

While latch guards of the type described above generally have been effective for preventing tampering with the latch and spreading of the door frames, they have been plagued by installation problems and other undesirable drawbacks. For example, most residential locks are installed at a certain distance from the edge of the door called the backset. Residential locks typically are installed at a backset of approximately $2\frac{3}{8}$ inches, while commercial locks are typically installed at a backset of approximately $2\frac{3}{4}$ inches. When the V-shaped groove of the cover plate is properly positioned to accept the protruding latch strike plate, oftentimes the cover plate will overlie a portion of the lock hardware on the outside surface of the door. Accordingly, the installer must carve out a portion of the cover plate to accommodate the lock hardware so that the cover plate can be installed flat against the door.

These carving procedures, however, are a very time consuming and undesirable operation. This is true even when only a single lock is installed on the door, such as a knob-type lock. Moreover, if both a knob-type lock and a dead bolt-type lock are used, the time and trouble in making two separate cutouts in the cover plate is doubled. Carving of the cover plate generally cannot be avoided, since the failure to carve the cover plate to accommodate the lock hardware will cause the V-shaped groove to be misaligned with the protruding latch strike plate, such that the groove will contact the latch strike plate, rather than freely receive it, thus preventing proper installation of the cover plate flat against the door. Even in cases where the cover plate is pre-carved to accommodate the lock hardware, it usually is not carved to receive both a knob-type lock and a dead bolt-type lock. Such pre-carved plates also are not carved sufficiently to accommodate locks installed at different backsets, nor are they adapted for use with mortise locks or locks having large escutcheons.

In addition, bolts generally are used to install the latch guard on the door. These bolts typically have an enlarged head adapted to engage the outer surface of the cover plate, and an externally threaded shaft extending through a mounting hole in the cover plate and through a hole in the door. An internally threaded retaining nut, such as an acorn nut, is used to secure the shaft of each bolt at the back side of the door. In some prior art latch guards, however, the mounting holes in the cover plate are in such a position that, when the retaining nuts are installed on the bolt shaft at the back side of the door, the nuts interfere with a door stop on the door frame that keeps the door from swinging inwardly during closing of the door. In such cases, the installer must carve out a portion of the door stop to receive the protruding nuts. This procedure is made especially difficult when steel door frames and door stops are used. Oftentimes, the door frame and door stop are filled with concrete for reinforcing purposes. Hence, the installer must use two drill bits, one for drilling through the steel door stop and one for drilling through the concrete behind it, to carve out sufficient space to accommodate the retaining nuts. This causes further inconvenience for the installer.

Accordingly, there has existed a definite need for a latch guard for outwardly opening doors that protects the latches on doors having multiple locks positioned one above the other, that accommodates the protruding latch plates for locks installed at different backsets, and which does not require any special drilling or carving operations to install the latch guard. The present invention satisfies these needs and provides further related advantages.

SUMMARY OF THE INVENTION

The present invention is embodied in a door latch guard for guarding the latch of an outwardly opening door and for preventing spreading of the door away from an adjacent door frame. The latch guard comprises a cover plate having a special groove that overlies the door and the door frame and that is adapted to receive the protruding portion of a latch strike plate. This special groove, in combination with a specially configured cutout which enables the cover plate to be mounted flat against the door without interference with the door lock hardware, provides a latch guard that can be installed on a door having one or more locks installed at a plurality of different backsets. The latch guard of the present invention furthermore is intended to be relatively inexpensive to manufacture, reliable in use and simple to install.

The cover plate comprises a first substantially flat portion for connection to the outside surface of the door, and a second substantially flat portion adapted to overlie the adjacent door frame. A third portion of the cover plate, between the first and second substantially flat portions, defines the groove adapted to overlie the door and the door frame and the space therebetween. The groove includes a substantially flat section having a width in the preferred embodiment of approximately 0.5 inches. As described below, this groove configuration enables the cover plate to receive the portion of the latch strike plate protruding outwardly from the door frame, regardless of whether the door lock is installed at a residential backset of approximately 2⅜ inches or a commercial backset of approximately 2¾ inches.

In a related aspect of the invention, the first substantially flat portion of the cover plate includes an elongated cutout adapted to accommodate a plurality of locks installed one above the other in the door. The cutout is defined by the inner edge of the first flat portion of the cover plate adjacent to the door hardware of the locks. The first flat portion of the cover plate further includes an upper mounting flange positioned above a first lock mounted in the door, and a lower mounting flange positioned below a second lock mounted in the door below the first lock. The upper and lower flanges each have a mounting hole for receiving a bolt adapted to connect the upper and lower flanges of the cover plate flat against the outside surface of the door.

Each of the mounting bolts has an enlarged head adapted to abut against the outside surfaces of the cover plate's upper and lower flanges, and a threaded shaft extending through the mounting holes in the flanges and through holes in the door. A portion of each bolt shaft extends through the door and protrudes outwardly beyond the inside surface of the door. This portion of the shaft has external threads for threaded engagement with an internally threaded retaining nut.

The mounting holes of the upper and lower flanges are positioned such that, when the retaining nuts are mounted to the bolt shafts at the inside surface of the door and the door is then closed, the nuts are mounted at a location spaced inwardly from, and free of interference with, a door stop on the door frame that limits inward swinging of the door when the door is being closed. Hence, when the door is closed, the retaining nuts will not hit or interfere with the door stop. As a result, the installer does not need to carve out a portion of the door stop to receive the retaining nuts protruding from the inside surface of the door.

The foregoing configuration of the cover plate, with its specially shaped groove and cutout, allows the cover plate to be installed flat against the door, without the need for special carving or cutting procedures, regardless of the backset at which the locks are installed. When the locks are installed at different backsets, the inner edge of the first flat portion of the cover plate can be placed adjacent to the door hardware of the locks such that the cover plate is flat against the outside surface of the door. The cover plate can be adjusted in a horizontal direction, if necessary depending on the backset, yet still receive the protruding portion of the latch strike plate without interference. This advantage is provided by virtue of the groove and its flat portion, which provides a relatively wide space to accommodate the protruding latch strike plate regardless of the backset involved.

The latch guard of the present invention can be used on outwardly opening doors having either one lock, such as a knob lock, or two locks, such as knob lock and a dead bolt lock mounted one above the other. The latch guard also can be used to protect the latch on doors having mortise locks or locks having large escutcheons.

Other features and advantages of the present invention will become apparent from the following description of the preferred embodiment, taken in conjunction with the accompanying drawings, which illustrate, by way of example, the principles of the invention.

BRIEF DESCRIPTION OF THE DRAWINGS

The accompanying drawings illustrate the invention. In such drawings.

DESCRIPTION OF THE PREFERRED EMBODIMENT

Figure 1:
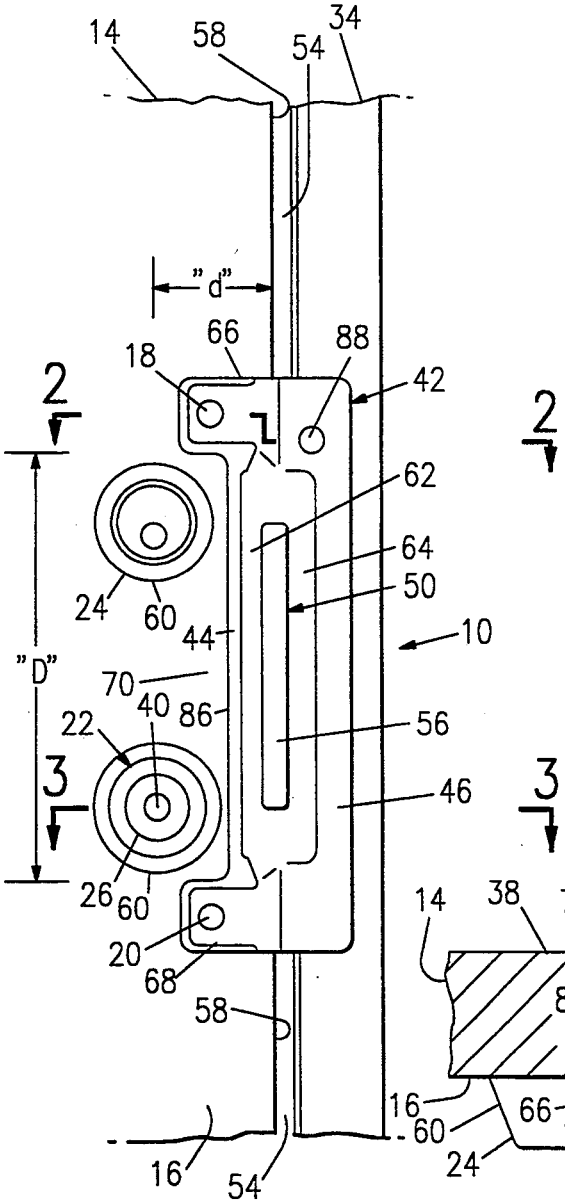
FIG. 1 is a front elevational view of a latch guard embodying the novel features of the present invention, shown installed on an outwardly opening door.

As shown in the exemplary drawings, the present invention is embodied in a latch guard, generally referred to by the reference numeral 10, for guarding a latch 12 and resisting the unauthorized opening of a locked door 14 and, more particularly, an outwardly opening locked door.

FIG. 1 shows the latch guard 10 installed on the outside surface 16 of the door 14 by a pair of mounting bolts 18 and 20. Two door locking mechanisms are installed on the door, comprising a knob lock 22 and a dead bolt lock 24. The knob lock 22 and the dead bolt lock 24 are shown mounted one above the other in the conventional manner.

The knob lock 22 utilizes a retractable spring-loaded latch 12 operated by door knobs 26 and 28 rotatable from either side of the door 14. When the door 14 is closed, the latch 12 contacts a latch strike plate 30 causing the latch to recede within the door until it is aligned with a socket 32 formed within an adjacent door jamb or frame 34 (see FIG. 3). Once aligned, the latch 12 springs into the socket 32 to retain the door 14 in the closed position. The inward travel of the door 14 is limited by a door stop 36 connected to the door frame 34 that is adapted to engage the back or inside surface 38 of the door when it is completely closed and the latch 12 is received within the socket 32.

The door knob 28 on the inside surface 38 of the door 14 typically has a button-type locking mechanism (not shown) which, when engaged, prevents the door knobs 26 and 28 from being rotated to disengage the latch 12 from the socket 32. The other door knob 26 on the outside surface 16 of the door 14 typically has a key mechanism 40 to disengage the door's locking mechanism such that the door knobs 26 and 28 can be rotated to retract the latch 12 from the socket 32. The dead bolt lock 24 also has a latch (not shown) adapted to be received within a socket of the door frame 34 in a conventional manner.

Figure 3:
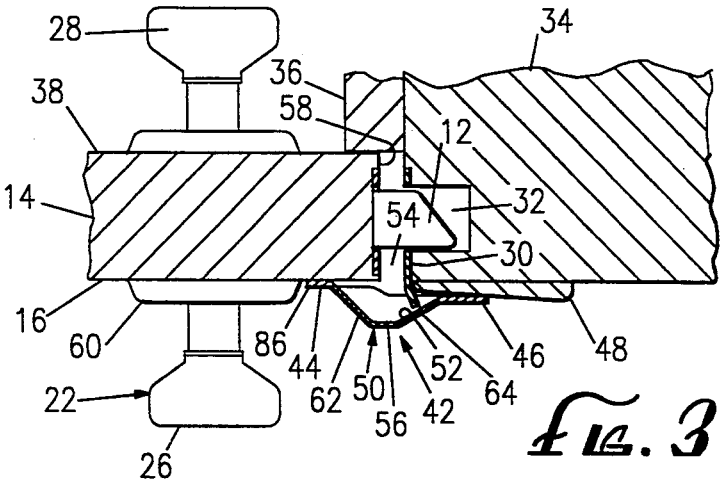
FIG. 3 is a partial cross-sectional view of the latch guard, taken substantially along line 3—3 of FIG. 1.

As shown best in FIGS. 1 and 3, the latch guard 10 comprises a cover plate 42 having a first substantially flat portion 44 adapted to overlie the outside surface 16 of the door, and a second substantially flat portion 46 adapted to overlie the adjacent door frame 34. If necessary, the second flat portion 46 of the cover plate 42 overlying the door frame 34 may be offset slightly from the first flat portion 44 overlying the door 14 in order to accommodate door trim 48 or the like connected to the door frame 34.

In accordance with the invention, the cover plate 42 further includes a third portion 50 between the first and second flat portions 44 and 46 defining a groove 52 adapted to overlie the door 14 and the door frame 34 and the space 54 therebetween. The groove 52 comprises a substantially flat outer section 56 at a location furthest from the outside surface 16 of the door 14. As explained in more detail below, this flat section 56 effectively widens the total width of the groove 52, such that the groove is adapted to receive a portion of the latch strike plate 30 protruding outwardly from the door frame 34, and such that the groove is wide enough to receive the latch strike plate for a lock installed in the door at a plurality of different backsets.

In this regard, most residential locks are installed at a predetermined distance "d" from the edge 58 of the door 14 closest to the door frame 34. This distance "d" is called the backset. For example, most residential locks are installed at a backset of approximately $2\frac{3}{8}$ inches, while most commercial locks are installed at a backset of approximately $2\frac{3}{4}$ inches. By providing a relatively wide groove 52 with a relatively flat outer section 56, the latch guard 10 of the present invention is adapted to be mounted on the outside surface 16 of the door 14, without interfering with any door hardware 60 of the knob lock 22 or the dead bolt lock 24, yet still receive the protruding latch strike plate 30 when the locks 22 and 24 are installed in the door 14 at a plurality of different backsets.

More particularly, the third portion 50 of the cover plate 42 defining the groove 52 comprises a first tapered section 62 tapered outwardly from the door 14 and connected to the first flat portion 44 of the cover plate, and a second tapered section 64 tapered outwardly from the door frame 34 and connected to the second flat portion 46 of the cover plate. The flat outer section 56 connects the first and second tapered sections 62 and 64 to each other. In this way, the first tapered section 62, the second tapered section 64 and the flat outer section 56 define the groove 52 that is spaced outwardly from the door 14, the door frame 34 and a space 54 therebetween. In the preferred embodiment, the width of the flat outer section 56 is approximately 0.5 inches, and the overall width of the groove 52 is approximately 1.5 inches.

In a related aspect of the invention, the cover plate 42 is mounted to the door 14 by a pair of mounting flanges comprising an upper mounting flange 66 and a lower mounting flange 68. The upper mounting flange 66 is spaced above the dead bolt lock 24, and the lower mounting flange 68 is spaced below the knob lock 22. This configuration of the upper and lower flanges 66 and 68 effectively provides a cutout 70 in the first flat portion 44 of the cover plate 42 overlying the outside surface 16 of the door 14. In one-embodiment of the invention, the vertical distance "D" between the bottom edge of the upper mounting flange 66 and the top edge of the lower mounting flange 68 is approximately $8\frac{3}{4}$ inches. This vertical distance "D" of $8\frac{3}{4}$ inches is large enough to accommodate most doors having two locks installed one above the other, as shown in FIG. 1.

The cover plate 42 is mounted to the outside surface 16 of the door 14 by an upper mounting bolt 18 and a lower mounting bolt 20. Each of these mounting bolts 18 and 20 is the same and, therefore, only the upper mounting bolt 18 will be described in connection with FIG. 2. The upper mounting bolt 18 has an enlarged head 76 for engagement with the outside surface of the upper mounting flange 66 and has a shaft 78 received through a mounting hole 80 in the upper mounting flange 66 and through a hole 82 in the door 14. A portion of the bolt shaft 78 protrudes from the inside surface 38 of the door 14 and has external threads for threaded engagement with an internally threaded retaining nut 84, such as an acorn nut. The lower mounting flange 68 is secured to the door 14 by the lower mounting bolt 20 in the same manner described above.

The foregoing configuration of the cover plate 42, and the cooperation between the groove 52 and the cutout 70, enables the cover plate to be installed on an outwardly opening door 14 in which, for example, the knob lock 22 and the dead bolt lock 24 are installed in the door at a plurality of different backsets. Regardless of the backsets of the locks 22 and 24, the cover plate 42 can be mounted flat against the door 14, without interfering with the lock hardware 60, by virtue of the cutout 70 in the first flat portion 44 of the cover plate 42 between the upper and lower mounting flanges 66 and 68.

For example, FIG. 3 shows the knob lock 22 installed in the door 14 in a commercial application, in which the knob lock is installed at a backset of approximately $2\frac{3}{4}$ inches. In this application, the inner edge 86 of the first flat portion 44 of the cover plate 42 is mounted in close proximity to the door hardware 60 of the knob lock 22. At this backset, the protruding portion of the latch strike plate 30 is received within the groove 52 at a location nearest the second flat portion 46 of the cover plate 42. However, if the knob lock 22 and dead bolt lock 24 were installed in a residential application at a backset of approximately $2\frac{3}{8}$ inches, then it would be necessary to mount the cover plate 42 at a location on the door 14 closer to the edge 58 of the door. It is necessary to move the cover plate 42 in this manner so as not to interfere with the lock hardware 60, which is closer to the edge 58 of the door 14 by virtue of the smaller backset associated with the residential application. Nevertheless, when the cover plate 42 is moved closer to the edge 58 of the door 14, the protruding portion of the latch strike plate 30 is still received within the groove 52 without interfering with the cover plate. It will be appreciated that, by moving the cover plate 42 closer to the edge 58 of the door 14 (to the right in FIG. 3), the protruding portion of the latch strike plate 30 will be received within the groove 52 at a location that is closer to the first flat portion 44 of the cover plate 42.

The ability of the cover plate 42 to be installed on the door 14 at a plurality of different backsets, without interfering with the door lock hardware 60 or the protruding latch strike plate 30, provides several important advantages. One very significant advantage is that the installer does not need to carve out a portion of the cover plate 42 to accommodate the lock hardware 60 so that the cover plate can be installed flat against the door 14. This greatly reduces the amount of time necessary to install the latch guard 10. By eliminating carving of the cover plate 42 when two locks 22 and 24 are installed on the door 14 one above the other, the latch guard 10 of the present invention saves further time and trouble for the installer, since it is not necessary to make two separate cutouts in the cover plate. Thus, when double locks 22 and 24 are involved, installation time is reduced even further. Instead, the installer need only place the cover plate 42 on the outside surface 16 of the door 14 centered over the latch 12 (or latches) of the door lock 22 (or locks) and free of interference with the door lock hardware 60. During this centering process, the cover plate 42 can be adjusted in a horizontal direction so that the protruding portion of the latch strike plate 30 is received freely within, and does not interfere with, the groove 52. The center of the mounting holes 80 in the upper and lower mounting flanges 66 and 68 is then marked on the door 14 by a pencil or other suitable marking instrument, and the cover plate 42 is removed. Two holes 82 are then drilled through the door 14 corresponding to the markings which in the preferred embodiment are 5/16 inch in diameter holes. The cover plate 42 is repositioned on the door 14 and the mounting bolts 18 and 20 are inserted through the mounting holes 80 in the cover plate and through the holes 82 in the door and secured by the retaining nuts 84.

In a further aspect of the invention, the mounting holes 80 in the upper and lower mounting flanges 66 and 68 of the cover plate 42 are positioned such that, when the retaining nuts 84 are installed on the bolt shaft 78 at the inside surface 38 of the door 14, the nuts do not interfere with the door stop 36. This advantage of the invention is provided by providing sufficient vertical distance "D" between the upper and lower mounting flanges 66 and 68 such that they may be mounted, respectively, above and below the locks 22 and 24 (or lock) in the door 14. This allows the mounting holes 80 to be located on the upper and lower mounting flanges 66 and 68 at a location that is spaced inwardly from the edge 58 of the door 14 by a sufficient amount to avoid interference with the door stop 36 abutting against the inside surface 38 of the door.

This feature of the invention allows the cover plate 42 to be installed on the door 14 without requiring the installer to carve out a portion of the door stop 36 to receive the protruding nuts 84. Eliminating these carving procedures it is especially advantageous when steel door stops are involved. Oftentimes, these door stops and their associated door frames are filled with concrete for reinforcing purposes. Hence, the installer does not need to carry two drill bits, one for drilling through the steel door stop and one for drilling through the concrete behind it, since it is totally unnecessary to carve out any space in the door stop 36 to accommodate the retaining nuts 84. This greatly minimizes the amount of time needed to install the latch guard 10 of the present invention.

Figure 2:
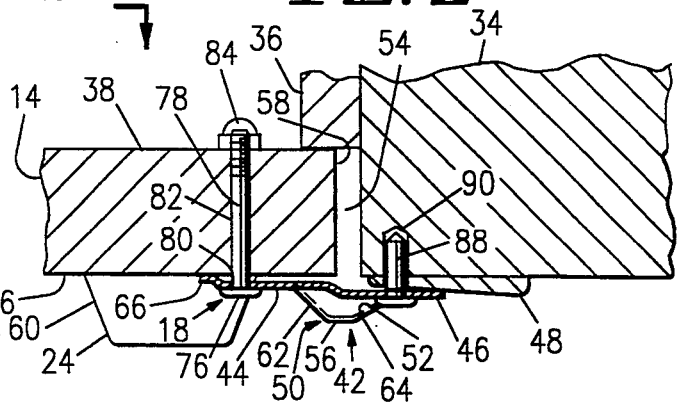
FIG. 2 is a cross-sectional view of the latch guard, taken substantially along line 2—2 of FIG. 1.

As shown in FIG. 2, the latch guard 10 of the present invention also may be provided with an anti-spread pin 88 to prevent spreading of the door frame 34 away from the door 14 by an intruder using a car-jack device (not shown) or the like. The anti-spread pin 88 is positioned in the second substantially flat portion 46 of the cover plate 42 such that the pin overlies the adjacent door frame 34. A hole 90 drilled in the door frame 34, for example, a $\frac{3}{8}$ inch diameter hole approximately $\frac{3}{4}$ inch deep, is adapted to receive the anti-spread pin 88 when the door 14 is closed. In this way, attempts to spread the door frame 34 away from the door 14 are defeated because the anti-spread pin 88 effectively connects the door frame 34 to the door 14.

The latch guard 10 of the present invention can be used on outwardly opening doors 14 having either one lock, such as a knob lock 22, or two locks, such as knob lock 22 and a dead bolt lock 24 mounted one above the other. The latch guard 10 also can be used to protect the latch on doors having mortise locks or locks having large escutcheons.

From the foregoing, it will be appreciated that the present invention provides a latch guard 10 for outwardly opening doors 14 that protects the latches 12 on multiple locks positioned one above the other and which accommodates the protruding latch strike plate 30 for locks 22 and 24 installed at a plurality of different backsets. Installation of the latch guard 10 is relatively quick and trouble free, since no special drilling or carving operations are necessary to install the latch guard.

While a particular form of the invention has been illustrated and described, it will be apparent that various modifications can be made without departing from the spirit and scope of the invention. Accordingly, it is not intended that the invention be limited, except as by the appended claims.

I claim:

1. A door latch guard for guarding a latch of an outwardly opening door, comprising:

an elongated cover plate having a first substantially flat portion adapted to be connected to the outside surface of an outwardly swinging door, a second substantially flat portion adapted to overlie an adjacent door frame, and a third portion between the first and second portions defining an elongated groove adapted to overlie the door and the door frame and the space therebetween, the groove including a substantially flat section that is substantially parallel to the first and second flat portions, wherein the flat section of the groove has a width of approximately 0.5 inches, such that the groove is adapted to receive a portion of a latch strike plate protruding outwardly from the door frame, and such that the groove is wide enough to receive a latch strike plate for a lock installed in the door at a plurality of different backsets.

2. The door latch guard of claim 1, wherein the lock is installed at a backset between approximately $2\frac{3}{8}$ inches and $2\frac{3}{4}$ inches.

3. The door latch guard of claim 1, wherein the first substantially flat portion of the cover plate includes an elongated cutout adapted to accommodate a plurality of locks installed one above the other in the door at a plurality of different backsets.

4. The door latch guard of claim 1, wherein the first substantially flat portion of the cover plate includes an upper flange positioned above a first lock mounted in the door, and a lower mounting flange positioned below a second lock mounted in the door below the first lock, wherein the upper and lower flanges each have a mounting hole for receiving a bolt adapted to connect the upper and lower flanges to the door.

5. The door latch guard of claim 4, wherein the mounting bolts each have an enlarged head adapted to abut against the outside surfaces of the upper and lower flanges and a threaded shaft extending through the mounting holes in the flanges and through holes in the door, further comprising an internally threaded retaining nut for threaded engagement with each of the shafts of the mounting bolts at the back side of the door.

6. The door latch guard of claim 5, wherein the retaining nuts are mounted to the bolt shafts at the back side of the door at a location spaced inwardly from and free of interference with a door stop on the door frame.

7. The door latch guard of claim 1, further comprising an anti-spread pin positioned in the second substantially flat portion of the cover plate adapted to overlie the adjacent door frame, wherein the pin has a shaft adapted to be received within an anti-spread hole in the door frame when the door is closed.

8. A door latch guard, comprising:

a cover plate having a first substantially flat portion adapted to be connected by fasteners to the outside surface of an outwardly opening door, the first portion having an elongated cut-out adapted to accommodate a plurality of locks installed one above the other in the door such that the first portion may be installed flat against the door, the cover plate having a second portion adapted to extend into overlapping relation with an adjacent door frame into which latches of the locks are secured, at least one of the locks having a latch strike plate extending outwardly with respect to the door frame beyond the outside surface of the door, and wherein the second portion includes a groove adapted to receive the outwardly extending latch strike plate, the groove having a substantially flat section that is substantially parallel to the first portion and that, in combination with the elongated cut-out, is wide enough to receive a latch strike plate for a lock installed in the door at a plurality of different backsets between approximately $2\frac{3}{8}$ inches and $2\frac{3}{4}$ inches, while still allowing the first portion to be installed flat against the door.

9. A door latch guard, comprising:

an elongated cover plate having a first substantially flat portion adapted to be connected to the outside surface of an outwardly opening door, a second substantially flat portion adapted to overlie an adjacent door frame, and a third portion between the first and second portions adapted to overlie the door and the door frame and the space therebetween, the third portion having a first tapered section tapered outwardly from the door and connected to the first substantially flat portion, a second tapered section tapered outwardly from the door frame and connected to the second substantially flat portion, and a third flat section connecting the first and second tapered sections to each other, wherein the first tapered section, the second tapered section and the third flat section define a groove elongated in a vertical direction and spaced outwardly from the door, the door frame and the space therebetween, wherein the width of the third flat section is approximately 0.5 inches and the overall width of the groove is approximately 1.5 inches.

10. A door latch guard in combination with an outwardly opening door having a lock and latch, and a door frame having a latch strike plate, comprising:

an elongated cover plate having a first substantially flat portion connected to the outside surface of the outwardly opening door, a second substantially flat portion overlying the door frame, and a third portion between the first and second portions defining an elongated groove overlying the door and the door frame and the space therebetween, the groove including a substantially flat section that is substantially parallel to the first and second flat portions, wherein the flat section has a width of approximately 0.5 inches, such that the groove receives a portion of the latch strike plate protruding outwardly from the door frame, and such that the groove is wide enough to receive a latch strike plate for a lock installed in the door at a plurality of different backsets.

11. The combination of claim 10, wherein the lock is installed at a backset between approximately $2\frac{3}{8}$ inches and $2\frac{3}{4}$ inches.

12. The combination of claim 10, wherein the first substantially flat portion of the cover plate includes an elongated cutout adapted to accommodate a plurality of locks installed one above the other in the door at a plurality of different backsets.

13. The combination of claim 10, wherein the first substantially flat portion of the cover plate includes an upper flange positioned above a first lock mounted in the door, and a lower mounting flange positioned below a second lock mounted in the door below the first lock, wherein the upper and lower flanges each have a mounting hole for receiving a bolt that connects the upper and lower flanges to the door.

14. The combination of claim 13, wherein the mounting bolts each have an enlarged head that abuts against the outside surfaces of the upper and lower flanges and a threaded shaft extending through the mounting holes in the flanges and through holes in the door, further comprising an internally threaded retaining nut for threaded engagement with each of the shafts of the mounting bolts at the back side of the door.

15. The combination of claim 14, wherein the retaining nuts are mounted to the bolt shafts at the back side of the door at a location spaced inwardly from and free of interference with a door stop on the door frame.

16. The combination of claim 10, further comprising an anti-spread pin positioned in the second substantially flat portion of the cover plate that overlies the adjacent door frame, wherein the pin has a shaft which is received within an anti-spread hole in the door frame when the door is closed.

* * * * *